US006604675B2

(12) United States Patent
Southwell

(10) Patent No.: US 6,604,675 B2
(45) Date of Patent: Aug. 12, 2003

(54) DISPLAYABLE PRODUCE CONTAINER AND METHOD FOR MAKING THE SAME

(75) Inventor: James D. Southwell, Long Grove, IL (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 09/965,442

(22) Filed: Sep. 27, 2001

(65) Prior Publication Data

US 2002/0008134 A1 Jan. 24, 2002

Related U.S. Application Data

(63) Continuation of application No. 09/693,800, filed on Oct. 20, 2000, now Pat. No. 6,302,323.
(60) Provisional application No. 60/161,103, filed on Oct. 22, 1999.

(51) Int. Cl.[7] ..... B65D 5/22; B65D 21/032
(52) U.S. Cl. ..... 229/164; 229/171; 229/174; 229/178; 229/191; 229/915; 229/918; 229/919
(58) Field of Search ..... 229/164, 167, 229/168, 171, 174, 178, 191, 192, 915, 918, 919

(56) References Cited

U.S. PATENT DOCUMENTS 2,326,926 A * 8/1943 Bureau et al. ..... 229/171
2,522,597 A * 9/1950 Blandford ..... 229/192
2,914,235 A 11/1959 Jones ..... 229/164
RE25,050 E * 10/1961 Hamilton ..... 229/918
3,820,706 A 6/1974 Gibson et al.
3,863,831 A 2/1975 Wozniacki et al.
3,871,570 A 3/1975 Garmon
3,887,126 A 6/1975 Wilson ..... 229/171
3,910,484 A 10/1975 Wozniacki (List continued on next page.)

FOREIGN PATENT DOCUMENTS

FR 893 832 A1 11/1944 ..... 229/171
FR 2 728 867 A1 12/1994
GB 2 232 403 A1 12/1990 ..... 229/164
WO WO 99/43560 9/1999

*Primary Examiner*—Gary E. Elkins
(74) *Attorney, Agent, or Firm*—Jenkens & Gilchrist

(57) ABSTRACT

The present invention provides a stackable open-top container for use in shipping, storing and retail display of produce and other articles. The produce container contains a bottom wall, two side walls and two end walls. The ledges of the side walls of the present invention contain opposed concave curved scores. The produce container is formed by folding the side walls to the outside to achieve structural rigidity. The produce container of the present invention provides for full graphical coverage on all visible surfaces by use of a one-piece blank that is color coated/printed on only one side.

16 Claims, 8 Drawing Sheets

U.S. PATENT DOCUMENTS 3,917,156 A * 11/1975 Baudet ..... 229/191
3,940,053 A 2/1976 Putman et al.
4,003,514 A * 1/1977 Graser ..... 229/171
4,053,098 A 10/1977 Baptist
4,053,100 A 10/1977 Baptist
4,082,215 A 4/1978 Eichenauer
4,101,048 A 7/1978 Rieben et al.
4,151,948 A 5/1979 de la Fuente, Jr.
4,164,315 A 8/1979 Pennanen ..... 229/171
4,175,691 A 11/1979 Cornell et al.
4,260,098 A 4/1981 Manizza et al. ..... 229/171
4,291,830 A 9/1981 Sorensen
4,304,351 A 12/1981 Stollberg
4,335,843 A 6/1982 Kent
4,347,969 A 9/1982 Kost et al.
4,349,147 A 9/1982 Jensen
4,385,721 A 5/1983 Olsen et al.
4,391,405 A 7/1983 Drinon
4,417,686 A * 11/1983 Wozniacki ..... 229/191
4,418,863 A 12/1983 Kimbrell, Sr.
4,537,344 A 8/1985 Thomas
4,567,996 A 2/1986 Muise
4,573,633 A 3/1986 Brian ..... 229/171
4,600,142 A 7/1986 Quaintance ..... 229/143
4,613,045 A 9/1986 Watson ..... 206/512
4,676,429 A 6/1987 Crowe et al. ..... 229/109
4,770,339 A 9/1988 Weimer ..... 229/143
4,860,948 A * 8/1989 Hofstede ..... 229/918
4,883,221 A 11/1989 Brundage ..... 229/143
4,905,834 A * 3/1990 Gimeno et al. ..... 229/919
4,946,093 A 8/1990 Moorman ..... 229/128.19
5,000,377 A 3/1991 McClure ..... 229/154
5,002,224 A 3/1991 Muise ..... 229/169
5,052,615 A 10/1991 Edward et al. ..... 229/182
5,125,567 A 6/1992 McClure ..... 229/150
5,139,196 A 8/1992 Fry et al. ..... 229/157
5,163,609 A 11/1992 Muise, Jr. ..... 229/113
5,261,594 A 11/1993 Brown et al. ..... 229/191
5,285,956 A 2/1994 Piepho ..... 229/191
5,289,970 A 3/1994 McClure ..... 229/143
5,294,044 A 3/1994 Clark ..... 229/191
5,328,090 A 7/1994 Hanlon ..... 229/171
5,330,094 A 7/1994 Mertz ..... 229/167
5,361,975 A 11/1994 Droste et al. ..... 229/120.34
5,361,976 A 11/1994 Blomfield ..... 229/148
5,370,303 A 12/1994 Fry ..... 229/143
5,392,985 A 2/1995 Smith et al. ..... 229/125
5,429,296 A 7/1995 Southwell et al. ..... 229/919
5,516,034 A 5/1996 Jensen et al. ..... 229/120
5,535,941 A 7/1996 Garza ..... 229/191
5,562,227 A * 10/1996 Takezawa et al. ..... 229/918
5,649,663 A 7/1997 Pestow, Jr. ..... 229/190
5,673,848 A 10/1997 Garza ..... 229/191
5,687,902 A 11/1997 Tusing et al. ..... 229/198.1
5,704,193 A 1/1998 Roe et al. ..... 53/397
5,853,120 A 12/1998 McLeod et al. ..... 229/120.09
5,860,590 A 1/1999 Blomfield et al. ..... 229/165
5,979,746 A 11/1999 McLeod et al. ..... 229/120.09
6,131,805 A * 10/2000 Gasior ..... 229/191
6,302,323 B1 * 10/2001 Southwell ..... 229/164

* cited by examiner

DISPLAYABLE PRODUCE CONTAINER AND METHOD FOR MAKING THE SAME

CROSS-REFERENCE TO RELATED APPLICATIONS

This application is a continuation of U.S. application Ser. No. 09/693,800, filed Oct. 20, 2000, U.S. Pat. No. 6,302,323, which claims the benefit of priority of U.S. Provisional Patent Application No. 60/161,103, filed Oct. 22, 1999.

FIELD OF INVENTION

The present invention relates generally to containers for retaining, protecting and displaying articles and methods for making such containers. In particular, the present invention relates to a container having an open top formed from corrugated paperboard material and useful in shipping and displaying perishable produce.

BACKGROUND OF THE INVENTION

Flat sheets of corrugated paperboard, typically referred to as blanks, have been used for many years as the starting material to form produce containers. Corrugated paperboard generally refers to a multi-layer sheet material comprised of two sheets of liner bonded to a central corrugated layer of medium. Given a basic size requirement specified by the customer, industry standards, and the preference for low cost, paperboard container manufacturers strive to provide structural stacking strength with a minimal amount of corrugated paperboard. A typical well-known container is a single-piece tray design having a bottom wall, two side walls and two end walls each hinged to the bottom wall. Typically, a single piece of corrugated paperboard will be cut and scored to form a flat one-piece blank that will then be erected into this container.

Typical containers for the support and transport of food produce articles are corrugated containers having fixed configurations. These containers can be unstable when stacked and are prone to toppling. Many containers are not durable and flexible enough to protect and prevent damage to the produce. Furthermore, the side and bottom walls of produce containers are susceptible to buckling and twisting, leading to damage to the produce.

A packed container of produce will generally hold a weight suitable for handling by an individual. Such containers will be generally rectangular and have a variable height dimension. Further, these containers will normally be stacked for transport and storage. The cost of labor, in the form of the time required to handle the produce and to assemble the shipping containers, can be significant factors in the overall cost of the produce. Many current produce containers can only be assembled by hand, a method that is costly and time consuming. Assembling paperboard containers for set-up by a machine where cooperating adjoining paperboard sections are adhesively bonded to form the produce container can reduce cost and time.

It is important in the production, distribution and sale of perishable and non-perishable articles such as produce that the articles are safely and conveniently stored for transport and safely and securely shipped for sale. Safe and secure storage and shipping is particularly a problem if heavy items must be placed in containers that are stacked upon each other. Stackable produce containers often acquire, for example, bulging side or end walls, deformed bottom walls or smashed corners that damage the produce due to, for example, the weight of or movement of the produce during shipment. Further, if the environment in which the paperboard container is shipped or stored is refrigerated, the moisture present in a refrigerated environment is likely to be absorbed by and weaken the container.

Once the produce reaches a retail destination, the produce container is normally placed directly on display for consumer sale. This allows retailers to preserve time and money by not having to transfer produce into an alternative container for sales. If a produce container arrives to a retailer in a crushed or damaged state, however, the retailer usually cannot, for aesthetic purposes, exhibit the produce container. Furthermore, produce containers generally contain at least one or more visible panels that have not been painted or coated. Retailers that sell produce directly in the container that emanates from the grower usually do not, for aesthetic reasons, desire consumers to see unpainted or uncoated surfaces.

Vertically oriented corrugation fibers within a produce container are typically stronger and more secure than horizontally orientated fibers. Without structural rigidity, containers at or near the bottom of a stack of produce containers could buckle under the weight of the containers stacked above them. Generally, the end walls of a produce container contain vertically orientated corrugation fibers. Thus, it is preferable for the end walls to contain as few openings as possible. Optimal cooling efficiency, which enhances produce quality and shelf life, is also desirable. Cooling is achieved by including openings in each end wall to allow cool air flow from one end of the container to the other.

Accordingly, it is desirable to provide a container for transporting produce that is both durable and secure to prevent corrugation failure and produce damage, permits painting or coating or coating on all visible surfaces, yet allows sufficient air flow to achieve optimal cooling efficiency.

SUMMARY OF THE INVENTION

The present invention provides a stackable open-top container for use in shipping, storing and retail display of produce and other articles. The produce container contains a bottom wall, two side walls and two end walls. The ledges of the side walls of the present invention contain concave curved scores. The produce container is formed by folding the side walls to the outside to achieve structural rigidity. The produce container of the present invention provides for full graphical coverage on all visible surfaces by use of a one-piece blank that is color coated/printed on only one side.

Figure 1:
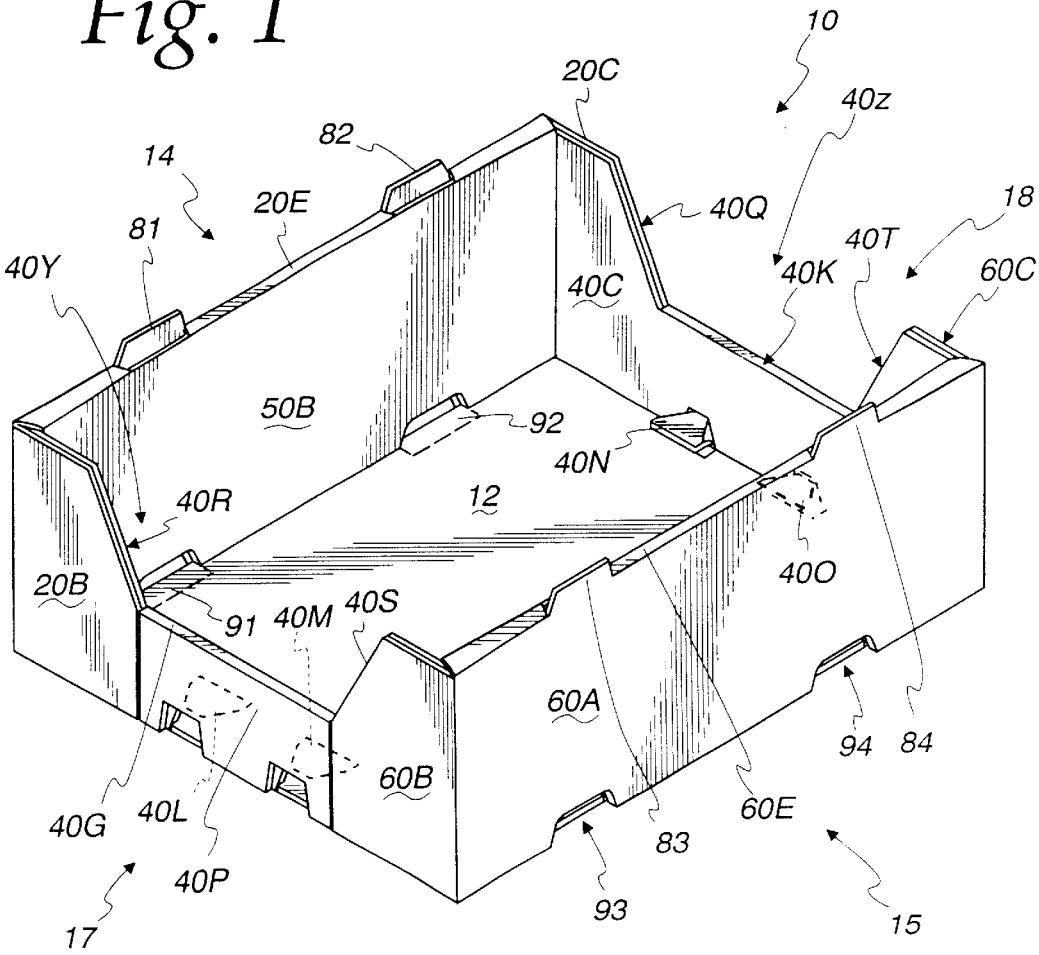
FIG. 1 is a perspective view of a stackable produce container embodying the present invention.

While the present invention is susceptible to various modifications and alternative forms, two embodiments thereof have been shown by way of example in the drawings and will herein be described in detail. It should be understood, however, that it is not intended to limit the invention of the particular forms disclosed, but on the contrary, the intention is to cover all modifications, equivalents and alternatives falling within the spirit and scope of the invention as defined by the appended claims.

DESCRIPTION OF ILLUSTRATIVE EMBODIMENTS

Turning now to the drawings, FIG. 1 illustrates a stackable produce container 10 composed of a relatively rigid material such as corrugated board, solid fiberboard, heavy paperboard, or heavy plastic sheet. The produce container 10 generally includes a bottom wall 12, a pair of opposing side walls 14, 15, and a pair of opposing end walls 17, 18.

To enhance the rigidity of the produce container 10, each side wall is formed from a pair of side panels and has a series of mirrored curves. In particular, the side wall 14 is formed from an inner side panel 50B and an outer side panel 20A (not shown) hingedly connected to each other along opposed, concave curved scores that form the outer edges of a first transverse concave-shaped ledge 20E of the side wall 14. The inner side panel 50B is hingedly connected with the bottom wall 12. Similarly, the side wall 15 is formed from an inner side panel 50A (not shown) and an outer side panel 60A hingedly connected to each other along opposed, concave curved scores that form the outer edges of a second transverse concave-shaped ledge 60E of the side wall 15. The inner side panel 50A is hingedly connected with the bottom wall 12 of the opposing ends. Each ledge 20E, 60E, contains a shoulder area that provides structural rigidity and prevents nesting. Generally, the nesting problem has been addressed in previous produce containers by adding a corner structure and allowing a minor flap to swing out and form a corner post. This leaves an area in each corner unusable and also produces an unsightly raw corrugated edge. The addition of shoulders to opposing ends of the side wall ledges allows the use of the entire corner area and eliminates all raw corrugated edges.

When folded, the opposed concave curved scores of the side panels cause the tension in the side walls to increase, thereby significantly improving the stacking strength of the produce container 10, reducing the possibility and improving the overall structural rigidity of the produce container 10. The two side panels of each side wall are attached to each other at a central point, or pinch point. A pinch point is the location at which the side panels connect or are closest to each other. It is contemplated in accordance with the present invention that the side walls may be canted or pitched inward toward the center of the produce container in order to compensate for the width of the shoulders on the ledges.

The concave-shaped ledges of the side walls contain wider shoulder areas at opposing ends. These shoulders provide surface areas to support produce containers disposed above the produce container 10 of the present invention. The shoulder areas substantially prevent nesting, which occurs when a box falls or "nests" into the open-top container below. If a stack of produce containers is jostled during shipment or incorrectly stacked so that individual containers get misaligned, the shoulders are sufficiently wide that one container stacked atop another will not tend to nest into the lower container. The size and shape of each of the shoulders maximize the openness of the container while virtually eliminating the possibility of nesting. The bowed inner side panels in connection with the shoulders on the concave-shaped ledges also significantly improve the torsional and flexural rigidity of the produce container 10 due to the shape of the side panels and the shape and thickness of the shoulders, thereby improving the stacking strength of the produce container 10.

The structural integrity of corrugated paperboard is related to its corrugation pattern or fluting structure. Corrugated paperboard is structurally strongest against forces applied in-line with its fluting structure and structurally weakest against forces applied perpendicular to its fluting structure. During shipping and stacking, produce containers are subject primarily to vertically-aligned forces such as the weight of produce containers stacked above a lower container and the forces encountered when a container is lifted or dropped. The corrugation patterns of the side walls are vertically aligned. Thus the vertical alignment of these patterns is more stable and secure than a horizontal corrugation alignment and reduces the possibility of panel deformation or crushing.

Another feature of the produce container 10 that significantly enhances its structural stability and stacking strength is that the minor end flaps that extend from opposing ends of the inner side panels 50A, 50B are secured and captured within the two panels of the side walls 14, 15. The two side wall panels and the minor end flaps combine to yield a side wall possessing three layers of corrugated material, significantly enhancing the stability and strength of the produce container 10. In addition, the three-layer structure of vertically-corrugated paperboard makes the side walls 14, 15 much more resistant than standard single-layer walls to bulging and to internal and external pressures that could cause the walls to buckle. In particular, minor end flap 40D is hingedly connected to an inner end panel 40B. Similarly, minor end flap 40E is hingedly connected to an inner end panel 40C. Minor end flaps 40D, 40E are each secured inside side wall 14, between side panels 20A and 50B. Minor end flap 40F is hingedly connected to an inner end panel 40B. Minor end flap 40H is hingedly connected to an inner end panel 40C. Minor end flaps 40F, 40H are each secured inside side wall 15, between side panels 50B and 60A. It should be apparent that the minor end flaps 40D, 40E are die-cut to conform to the profile of the side wall 14 without obstructing the stacking tabs or stacking receptacles. It should also be apparent that the minor end flaps 40F, 40H are die-cut to conform to the profile of the side wall 15 without obstructing the stacking tabs or stacking receptacles.

Figure 2:
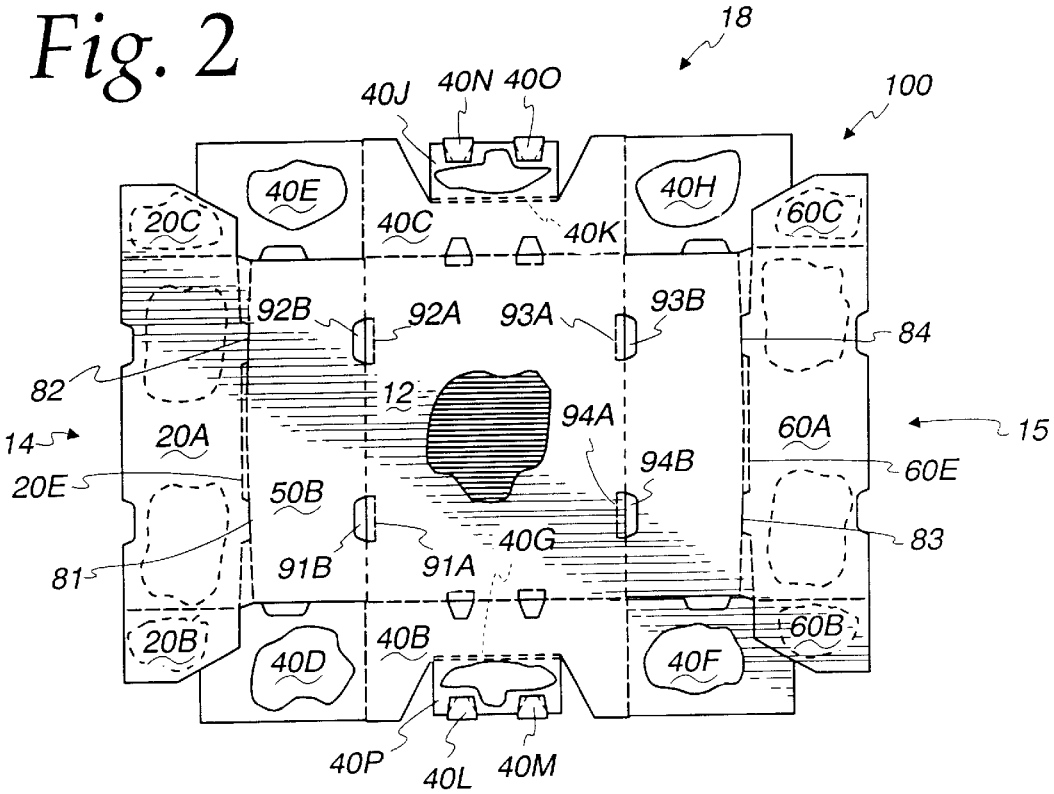
FIG. 2 is a plan view of a one-piece blank for forming the stackable produce container of the present invention in FIG. 1.

Minor side flaps 20B, 20C, 60B, 60C, extend from and are connected to opposing ends of the outer side panels 20A, 60A, as shown in FIG. 2. In particular, minor side flap 20B is hingedly connected to outer side panel 20A. Minor side flap 20B, when folded and attached to inner end panel 40B, as shown in FIG. 1, forms the outer corrugation layer for a portion of one corner of the produce container 10. Similarly, minor side flap 20C is hingedly connected to outer side panel 20A and is folded and attached to inner end panel 40C. Minor side flap 60B is hingedly connected to outer side panel 60A and becomes folded and attached to inner end panel 40B. Minor side flap 60C is hingedly connected to outer side panel 60A and is folded and attached to inner end panel 40C. The foregoing engagement of minor flaps extending from both the side walls and the end walls of the produce container 10 improves the structural rigidity and stacking strength of the container by locking and supporting the side walls 14, 15 and end walls 17, 18 generally orthogonal to the bottom wall 12.

Referring to FIG. 1, to permit stacking of several identical produce containers 10 in a reliable, stable, and balanced manner, the produce container 10 is provided with a plurality of stacking tabs and a plurality of stacking receptacles. In a preferred embodiment, two tabs 81, 82 extend upwardly from the upper transverse ledge 20E of the side wall 14. Similarly, two tabs 83, 84 extend upwardly from the upper transverse ledge 60E of the side wall 15. When an identical produce container is stacked on top of the produce container 10, the stacking tabs 81, 82, 83, 84 are received by receptacles akin to the receptacles 91, 92, 93, 94 of the produce container 10. It is contemplated in accordance with the present invention that each stacking tab could be formed from a single layer of corrugated material or a double layer of corrugated material.

As shown in FIG. 2, the stacking receptacles 91, 92 include respective first receptacle portions 91A, 92A in the bottom wall 12 and respective second receptacle portions 91B, 92B at the lower transverse edge of the inner side panel 50B of the side wall 14. Similarly, the stacking receptacles 93, 94 include respective first receptacle portions 93A, 94A in the bottom wall 12 and respective second receptacle portions 93B, 94B at the lower transverse edge of the inner side panel 50A of the side wall 15.

When the produce container 10 is stacked on top of an identical produce container, the stacking tabs of the lower container protrude through the first receptacle portions into the second receptacle portions of the respective receptacles. For example, a stacking tab akin to the tab 81 of the container 10 would extend through the first receptacle portion 91A into the second receptacle portion 91B of the receptacle 91.

To promote adequate air flow through the produce container 10, which is necessary to maintain proper produce ripeness, two large openings 40Y, 40Z, as shown in FIG. 1, are disposed in the end walls, 17, 18, respectively. The large opening 40Y is preferably formed with generally opposing opening edges 40R, 40S and a first end edge 40G. The opening edges 40R, 40S are disposed in close proximity to the respective side walls 14, 15 such that the large opening 40Y extends substantially across the length of the end wall 17. The first end edge 40G is disposed approximately midway between the upper and lower edges of the end wall 17 such that the large opening 40Y extends approximately halfway down from the uppermost edge of the end wall 17. Similarly, the large opening 40Z is preferably formed with generally opposing opening edges 40Q, 40T and the second end edge 40K. The side edges 40Q, 40T are disposed in close proximity to the respective side walls 14, 15 such that the large opening 40Z extends substantially across the length of the end wall 18. The lower ledge 40K is disposed approximately midway between the upper and lower edges of the end wall 18 such that the large opening 40Z extends approximately halfway down from the uppermost edge of the end wall 18.

The end wall 17 is formed from inner end panel 40B and outer end panel 40P hingedly connected to each other along the rigid first end edge 40G. The inner end panel 40B is hingedly connected with the bottom wall 12 and the outer end panel 40P is further connected to the inner end panel 40B by locking means 40K, 40L that interlock with locking slots 40U, 40V in the bottom wall. Similarly, the end wall 18 is formed from inner end panel 40C and outer end panel 40J hingedly connected to each other along the rigid end ledge 40K. The inner end panel 40C is hingedly connected with the bottom wall 12 and the outer end panel is further connected to the inner end panel 40B by means of locking tabs 40M, 40N that interlock with locking slots 40W, 40X in the bottom wall. Thus, the two end wall panels combine to produce end walls with two layers of corrugated material, further increasing the strength of the produce container 10. It is contemplated in accordance with one embodiment of the present invention that the outer end panels 40J, 40P can be further connected to the inner end panels 40B, 40C by means of an adhesive such as glue. The use of an adhesive to connect the inner and outer end panels would allow the end walls 17, 18 to remain free from laceration and increase strength and stability of the end wall and the entire produce container 10. Sample areas on produce container 10 containing adhesion have been indicated in FIGS. 2–7 by circular areas on the container flaps, walls and panels.

FIG. 2 depicts a plan view of the inner surface of a one-piece container blank 100 used for forming the produce container 10 in FIG. 1. The one-piece container blank is designed in such a manner so as to provide full graphical coverage on each visible interior and exterior surface of the container 10, with the exception of the exterior of the bottom wall, by color coating or printing only one side of the one-piece container blank 100. A produce container with color coating or printing on every visible surface will allow retailers to more assuredly sell the produce directly from the produce containers as they arrive from the grower because no bare or unpainted surfaces will be visible to a consumer. Furthermore, it is feasible that a grower could, when color-coating or printing the surface of the blank, include the retailer's store name or perhaps other advertising to further promote the retailer or other company.

The corrugation patterns for the produce containers of the present invention are shown in FIG. 2. The bottom wall 12 is corrugated from the base of one side wall to the base of another side wall, as illustrated. Each side wall panel is vertically corrugated, as shown, for example, in inner side wall panel 50B. Each end wall panel is horizontally corrugated, as shown, for example, in inner side wall panel 40B.

Figure 3:
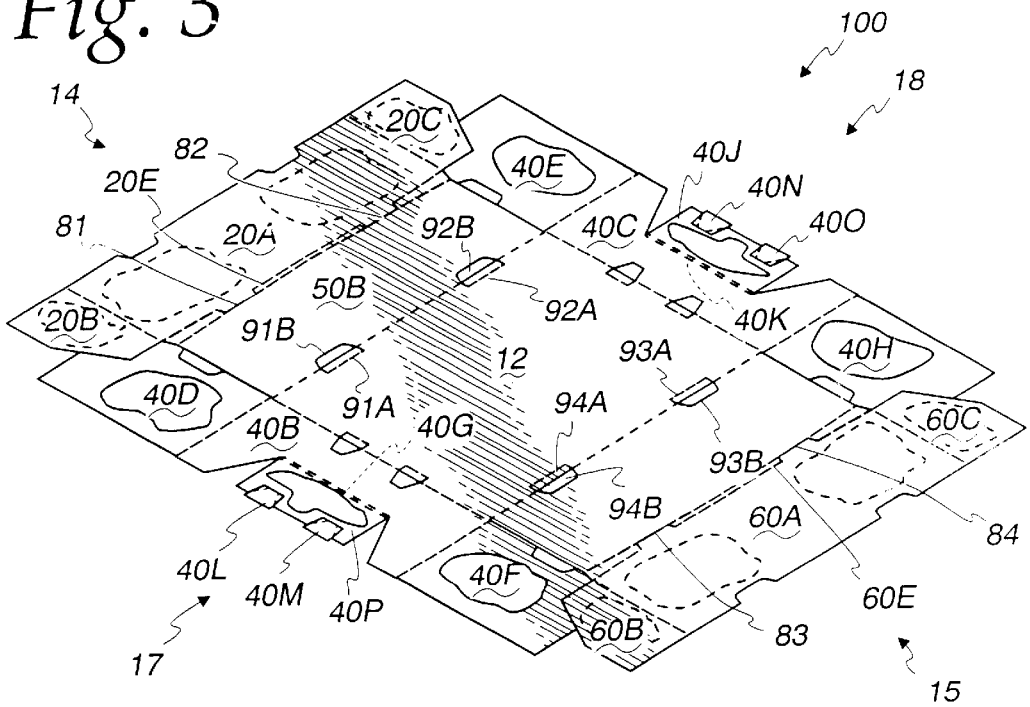
FIG. 3 is a perspective view of a one-piece blank for forming the stackable produce container of the present invention in FIG. 1.

As shown in the perspective view of FIG. 3, the one-piece container blank 100 is in the form of a planar, unitary section of rigid material such as corrugated board, solid fiber board, heavy paperboard, or heavy plastic sheet. With respect to the assembled produce container of FIG. 1, corresponding elements are indicated by the same reference numerals.

Figure 4:
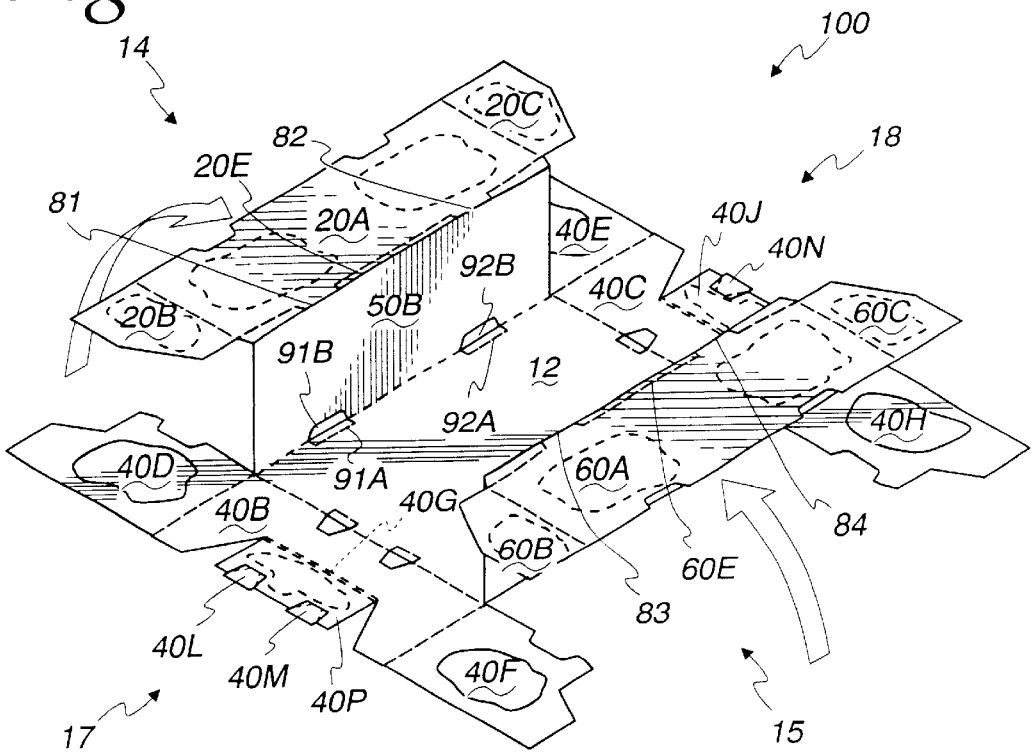
FIGS. 4 through 7 are perspective views illustrating the sequence that the panels of the one-piece blank in FIG. 3 are folded to form a stackable produce container embodying the present invention.
Figure 5:
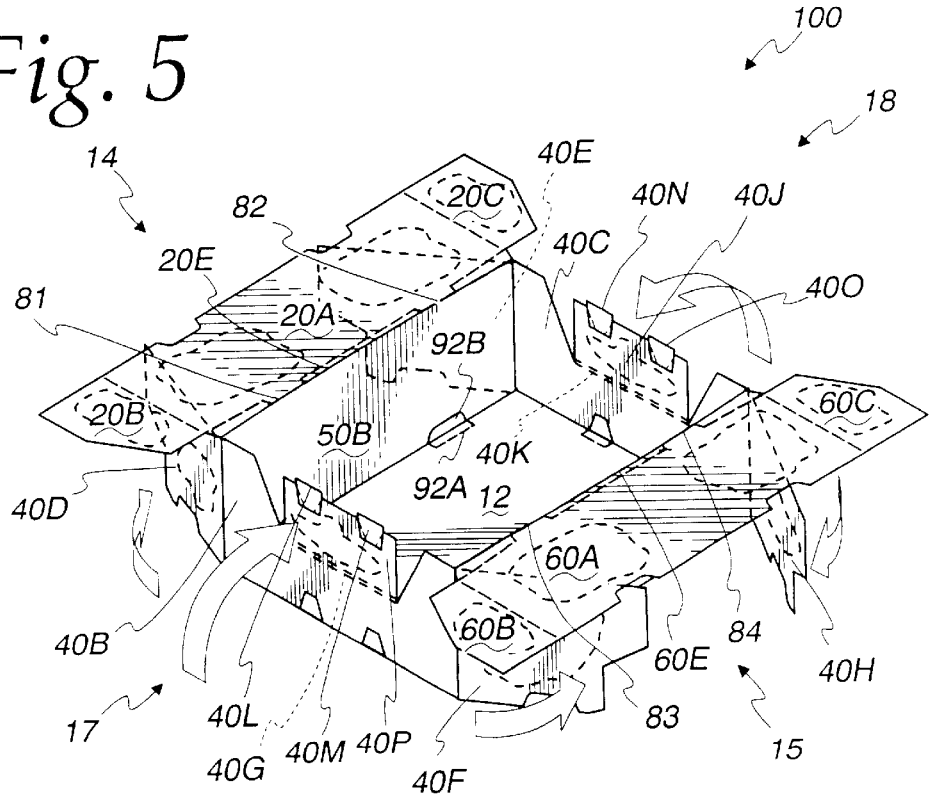

Using the sequence of folding steps detailed below and shown in FIGS. 4–7, the produce container 10 may be formed by hand or conventional tray-making equipment. However, the blank 100 has been manufactured and scored such that only one side of the blank 100 requires painting/coating to allow coverage on all visible sections of the produce container. First, as illustrated in FIG. 4, the inner side walls 50A, 50B are each rotated upward approximately 90 degrees relative to the bottom wall 12 so that the inner side walls 50A, 50B are generally parallel to each other. Second, as shown in FIG. 5, the end walls 17, 18 (including minor end flaps 40D, 40E, 40F, 40H) are each rotated upward approximately 90 degrees relative to the bottom wall 12 so that the end walls 17, 18 are generally parallel to each other. Third, the minor end flaps 40D, 40F are each rotated inward and folded approximately 90 degrees relative to the inner side wall 40B (see FIG. 5) and attached or adhered to the outer surface of the previously upwardly rotated inner side walls 50B, 50A, respectively. Similarly, the minor end flaps 40E, 40H are each rotated inward and folded approximately 90 degrees relative to the inner side wall 40C and attached or adhered to the outer surface of the previously upwardly rotated inner side walls 50A, 50B, respectively. It should be apparent that the minor end flaps 40D, 40E, 40F, 40H are die-cut to conform to the profile of the side wall without obstructing tab or receptacle openings.

Figure 6:
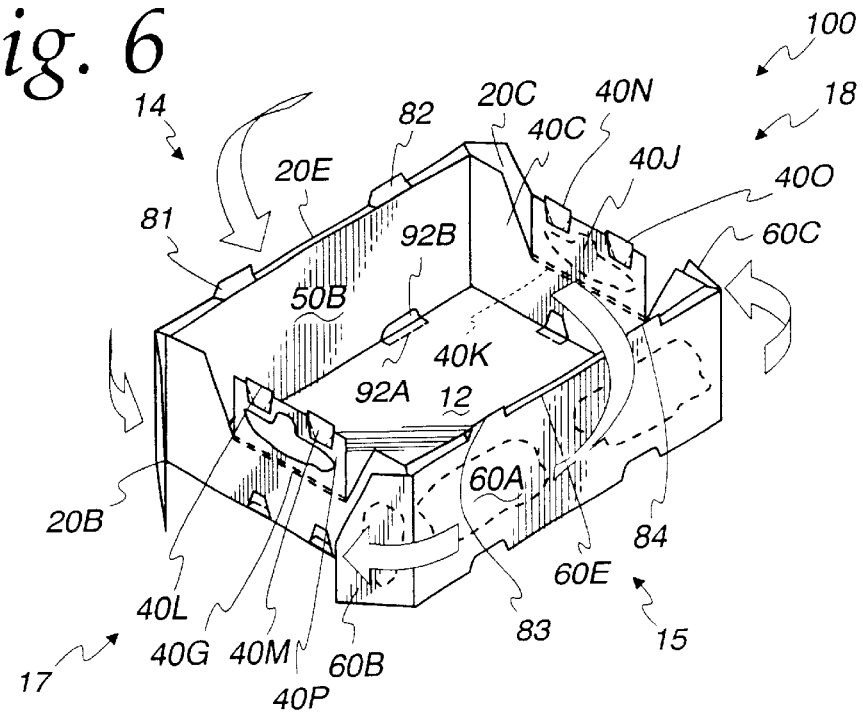

Fourth, as illustrated in FIG. 6, to form the bowed inner side panels 50A, 50B, and concave-shaped ledges 20E, 60E, the outer side walls 20A, 60A are each rotated outward and downward around a pair of curved score lines so that the minor end flaps 40D, 40E, 40F, 40H are secured and captured between the outer side walls and the inner side walls. Fifth, the minor side panels 20B, 60B are each rotated inwardly approximately 90 degrees relative to the outer side panels 20A, 60A, respectively (see FIG. 6). The minor side panels 20B, 60B are secured or adhered to opposing sides of the outer surface of end panel 40B. Similarly, the minor side panels 20C, 60C are each rotated inwardly approximately 90 degrees relative to the outer side panels 20A, 60A, respectively. The minor side panels 20C, 60C are secured or adhered to opposing sides of the outer surface of end panel 40C. It should be apparent that the minor side flaps 20B, 20C, 60B, 60C are die-cut to conform to the profile of the end walls without obstructing either the vents 40U, 40V, 40W, 40X, respectively, or the large openings 40Y, 40Z.

Figure 7:
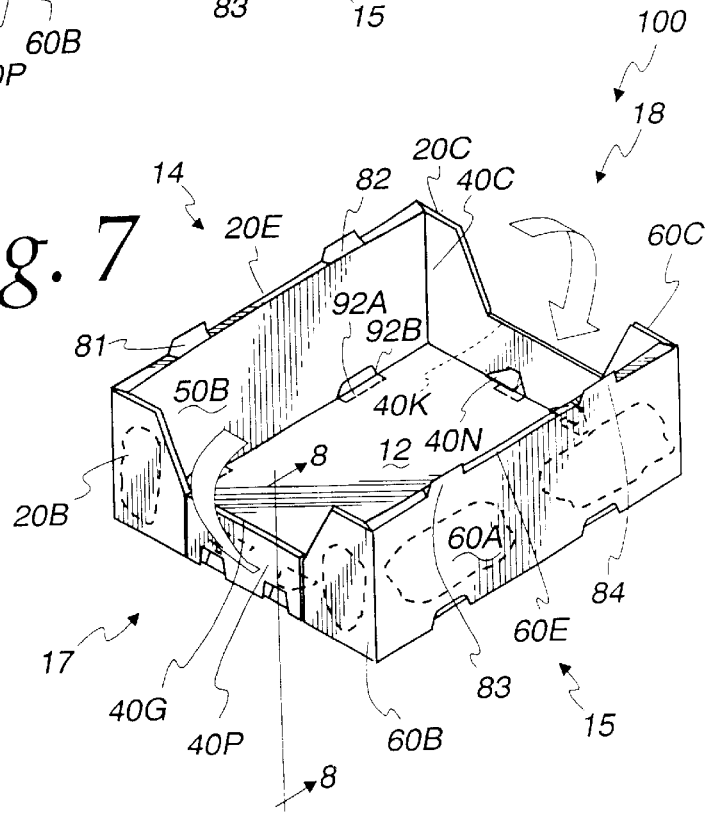
Figure 8:
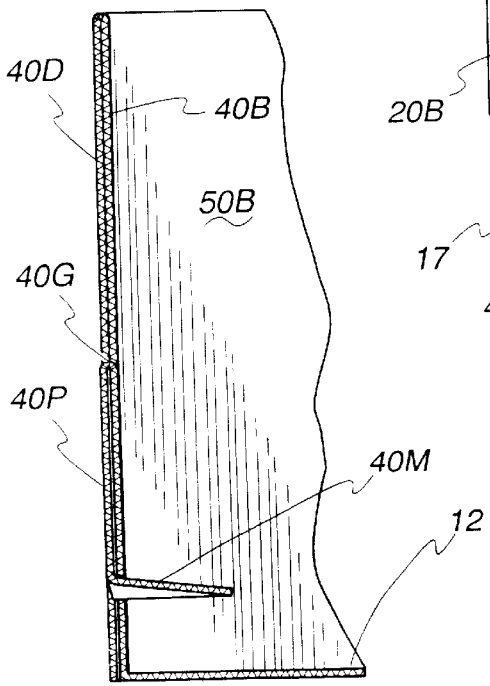
FIG. 8 is an enlarged cross-sectional view taken generally through line 8—8 in FIG. 7.

Sixth, as illustrated in FIG. 7, to form the first end edge 40G and the second end edge 40K, the outer end panels 40J, 40P, respectively, are folded downwardly and outwardly and attached to the inner end panels 40B, 40C, respectively. Seventh, the hand-set locks 40K, 40L, 40M, 40N are pushed inward, as shown in FIG. 7 and detailed in the cross-sectional view of FIG. 8, through the vents 40U, 40V, 40W, 40X, respectively, of the inner end panels to secure the outer end panels 40J, 40P to the inner end panels 40C, 40B, respectively. It is also contemplated in accordance with the present invention that the inner end panels could be adhered to said outer end panels. By folding the blank as described above, the produce container 10 is constructed to present an appearance with few raw or exposed edges of corrugated paperboard.

Figure 9:
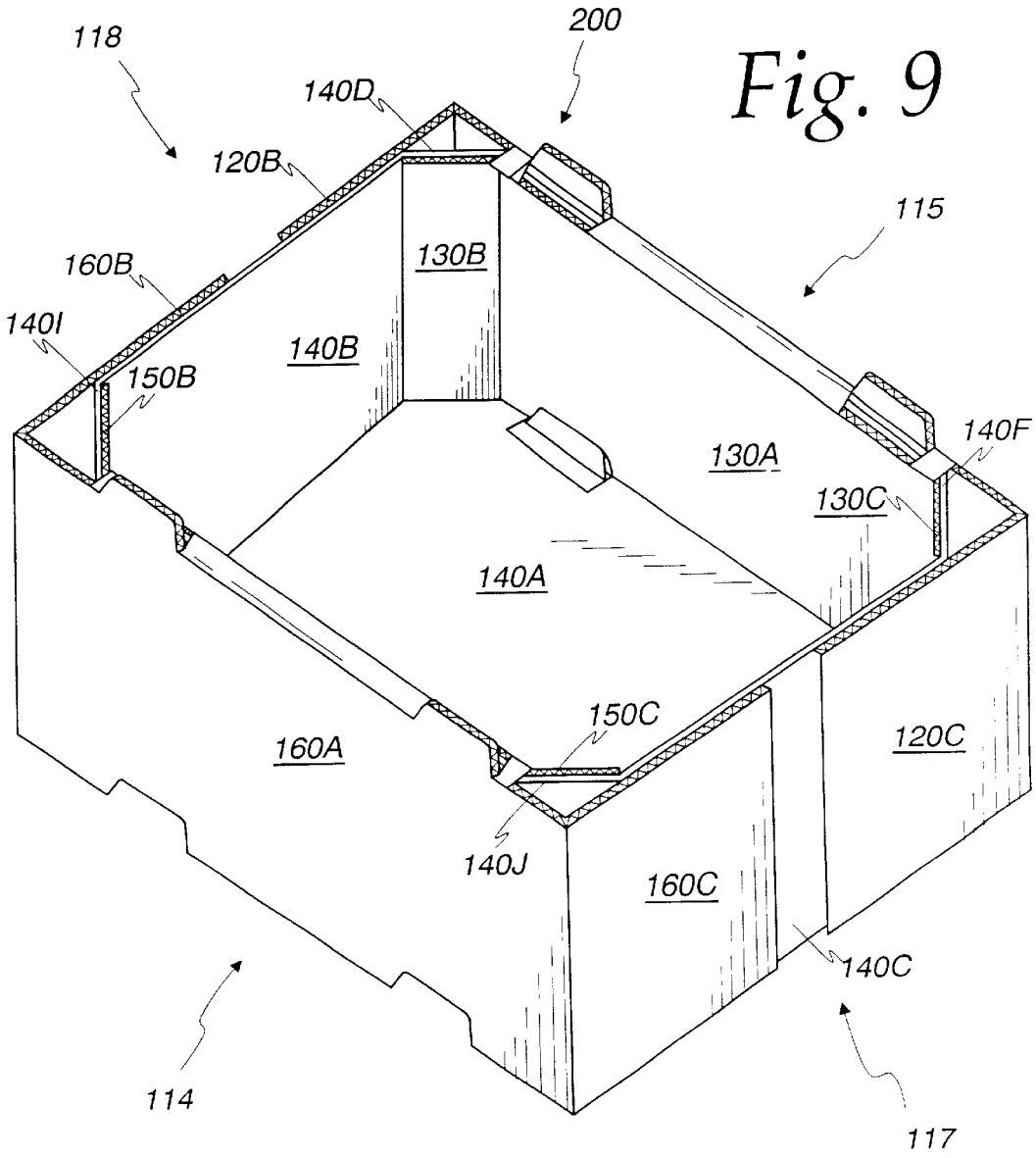
FIG. 9 is a perspective view of an alternative embodiment of a produce container of the present invention.

FIG. 9 illustrates a stackable produce container 200 of an alternative embodiment of the present invention. The produce container 200 generally include a bottom wall 112, parallel opposing side walls 114, 115, and parallel opposing end walls 117, 118.

Each side wall 114, 115 of produce container 200 is formed from an inner and an outer side panel. The inner side panels are hingedly connected to the outer side panels along an upper transverse ledge of each side wall. Each inner side panel is also hingedly connected with the bottom wall 112. The stacking strength of the produce container 200 is significantly increased with the addition of vertically-corrugated internal corner pieces 130B, 130C, 150B, 150C, minor side flaps that extend from opposing ends of the inner side panels.

Figure 10:
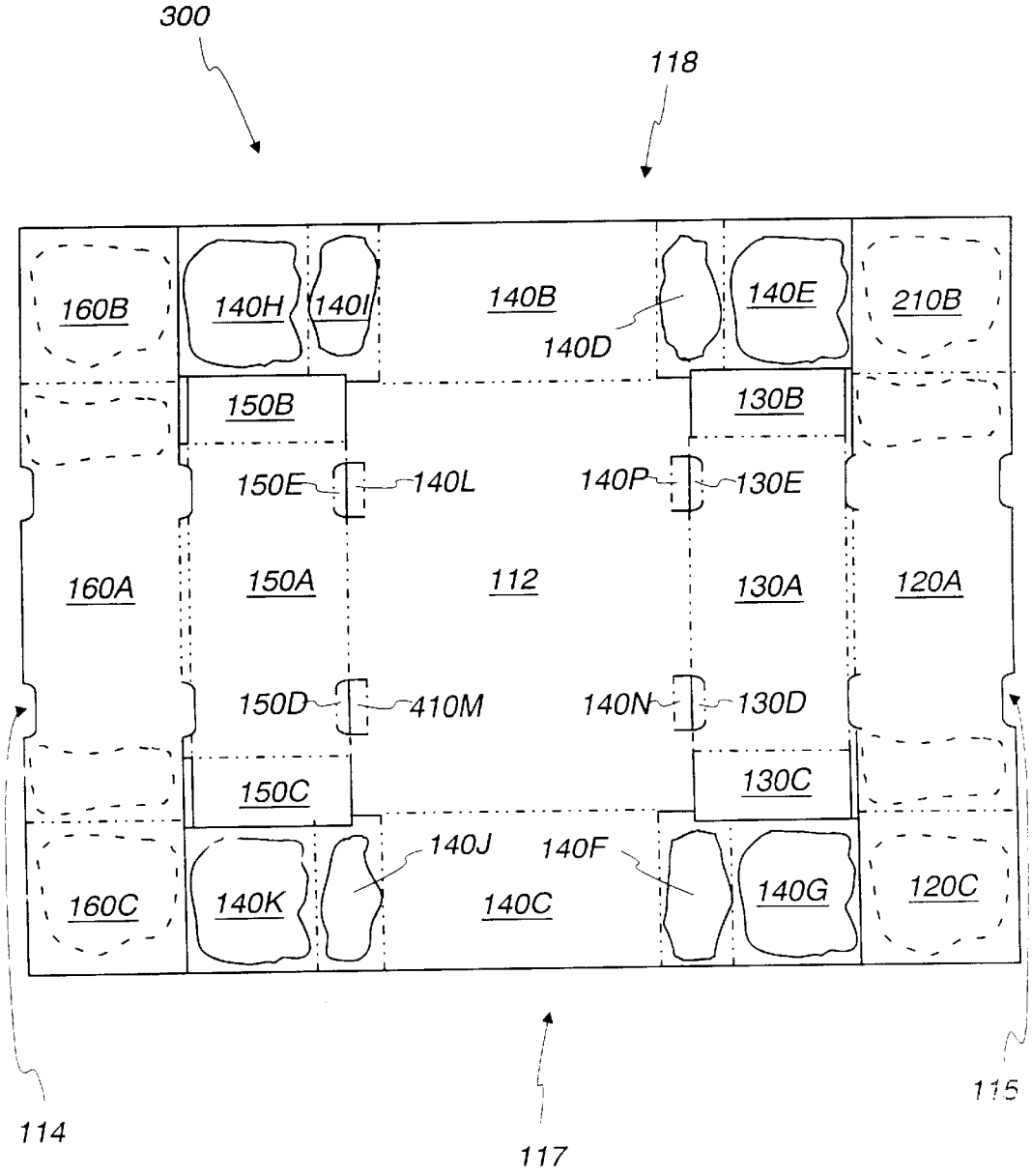
FIG. 10 is a plan view of a one-piece blank for an alternative embodiment of the present invention.

Each of the end panels 140B, 140C contains two sets of minor end flaps, a first set 140D, 140F, 140I, 140J, and a second set, 140E, 140G, 140H 140K, as shown in FIG. 10. Minor end flaps 140D, 140I, are hingedly connected to opposing ends of end panel 140B. Minor end flaps 140F, 140J are hingedly connected to opposing ends of end panel 140C. Further, the second set of minor end flaps 140E, 140G, 140H, 140K are hingedly connected to the first set of minor end flaps 140D, 140F, 140I, 140J. The second set of minor end flaps are folded and secured between the inner and outer side panels, as described below.

Each corner of produce container 200 will be further strengthened by the addition of the first set of horizontally-corrugated minor end flaps 140D, 140F, 140I, 140J. These The first set of minor end flaps provides the second layer of corrugation (in addition to the minor side flaps 130B, 130C, 150B, 150C) for each internal corner structure. A produce container 200 will be able to rest securely on the increased corner area provided after the addition of the internal corner flaps 130B, 130C, 150B, 150C, 140D, 140F, 140I, 140J.

Another feature that significantly enhances structural stability and stacking strength is that minor end flaps 140K, 140H, 140E, 140G that extend from opposing ends of the end walls are secured and captured between the inner side wall panels and the outer side wall panels. The two side wall panels and the minor end flaps combined to yield a side wall processing three layers of corrugated material, significantly enhancing the stability and strength of the produce container 200. Internal corner pieces (minor inner side flaps) 130B, 130C, 150B, 150C extend from and are connected to opposing ends of the inner side panels 150A, 130A, as shown in FIG. 10. In particular, minor side flap 150B is hingedly connected to inner side panel 150A. Minor side flap 150C is also hingedly connected to inner side panel 150A. Minor side panels 130C, 130B are hingedly connected to inner side panel 130A. The aforementioned engagement of minor flaps extending from both the side walls and the end walls of the produce container 200 improves the structural rigidity and stacking strength of the container by supporting and securing the side and end walls generally orthogonal to the bottom wall 112. The stacking tabs and stacking receptacles of this embodiment of the present invention are disposed in the same location of the stacking taps and the stacking receptacles described with respect to produce container 100 in FIGS. 1–8. FIG. 10 detects a plan view of the inner surface of a one-piece container blank 300 used for forming the produce container 200 in FIG. 9. The one-piece container blank 300 is designed in such a manner so as to provide full graphical coverage on each visible interior and exterior of the produce container 200, with the exception of the exterior of the bottom wall, such that color coating or printing is only required in one side of the one-piece container blank 300. As shown in the perspective view, FIG. 3, the one-piece container blank 300 is in a form of a planar, unitary section of rigid material such as corrugated paperboard. With respect to the assembled produce container of FIG. 9, corresponding elements are indicated by the same numerals.

Figure 11:
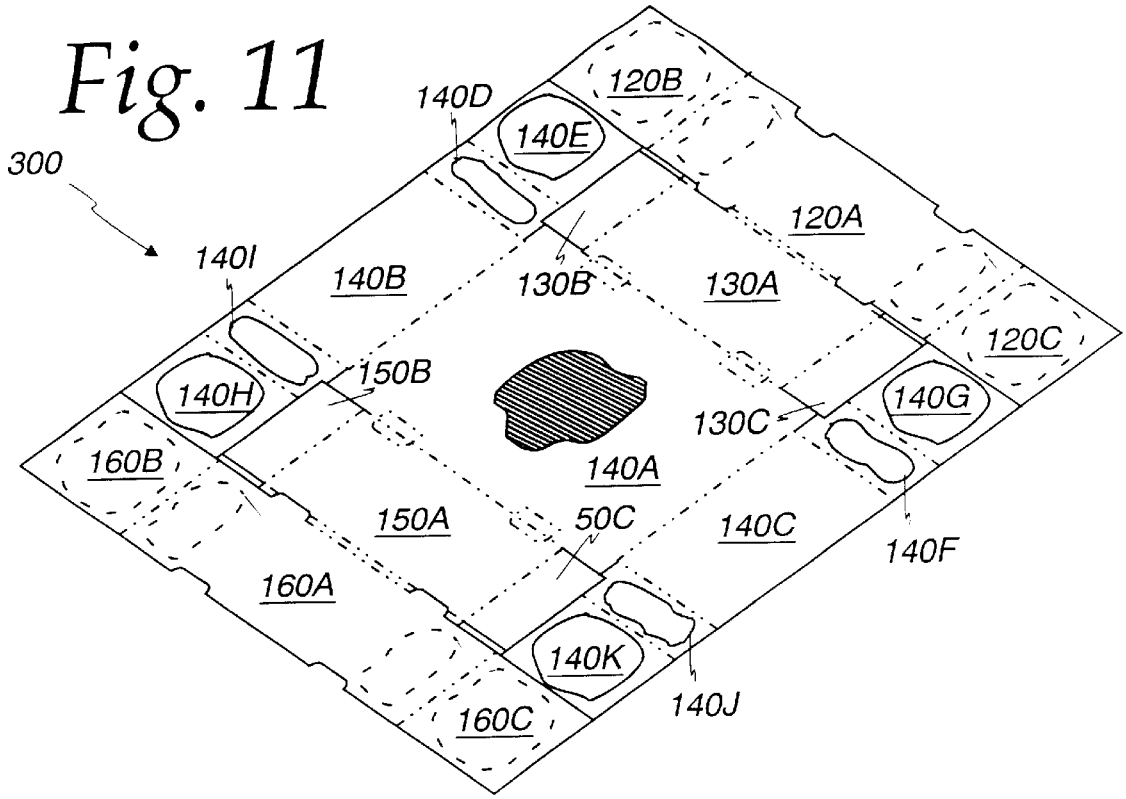
FIG. 11 is a perspective view of a one-piece blank of an alternative embodiment of the present invention.
Figure 12:
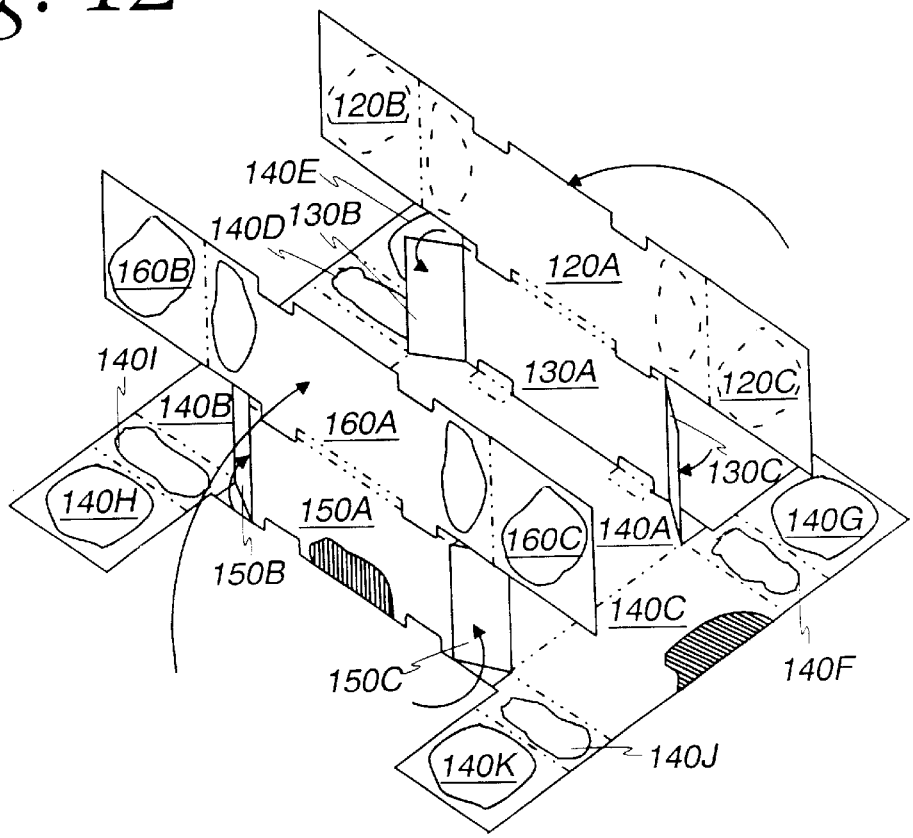
FIGS. 12 through 15 are perspective views illustrating the sequence that the panels of the one-piece blank of an alternative embodiment of the present invention are folded.

Using the sequence of folding step detailed blow shown in FIGS. 11–15, the produce container 200 of FIG. 9 may be formed by hand or conventional trade making equipment. However, the one-piece blank 300 has been manufactured and scored such that only one side of the one-piece blank 300 requires painting or coating to allow coverage on all visible section of the produce container. First, as illustrated in FIG. 12, the inner side panels 150A, 130A are each rotated upward approximately 90 degrees relative to the bottom wall 112 so that the inner side panels 150A, 130A are generally parallel to each other. The minor side flaps 150B, 150C extending from opposing ends of inner side panel 150A is each rotated inward approximately 45 degrees relative to the side wall 150A. Similarly, minor side panels 130B, 130C extending from opposing ends of inner side panel 130A of each rotated inward approximately 45 degrees relative to the inner side 130A. The corrugation patterns for the produce containers of this embodiment are shown in FIGS. 11–12. The bottom wall 112 is corrugated from the base of one side wall to the base of another side wall, as illustrated in FIG. 11. Each side wall panel is vertically corrugated, as shown, for example, in inner side wall panel 150A. Each end wall panel is horizontally corrugated, as shown, for example, in inner side wall panel 140C.

Figure 13:
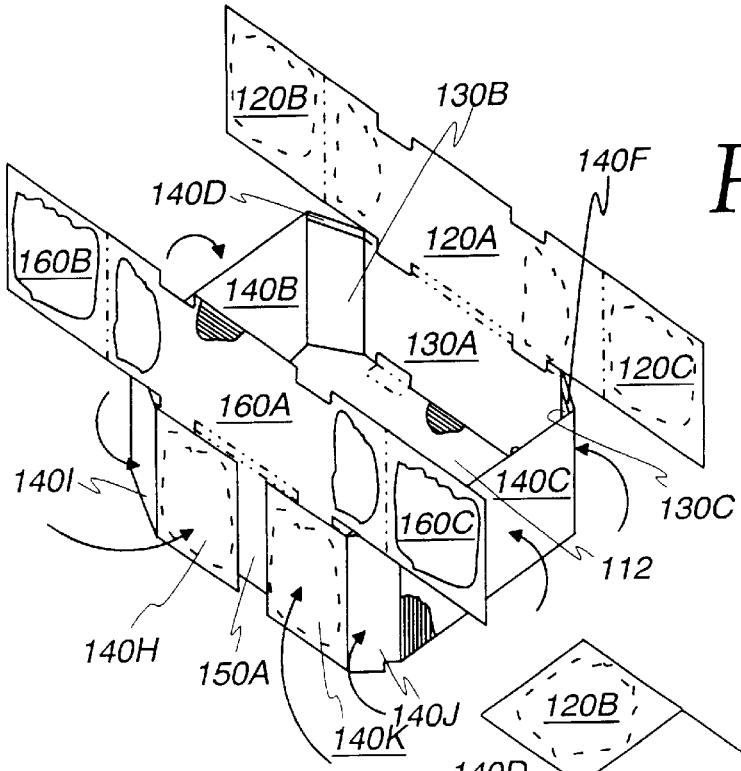
Figure 14:
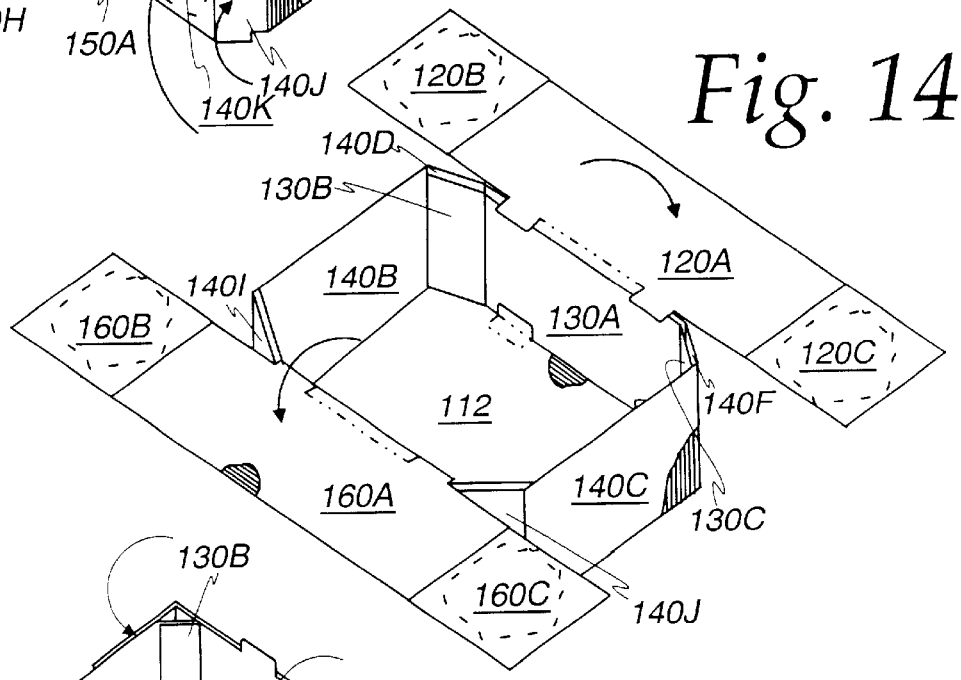
Figure 15:
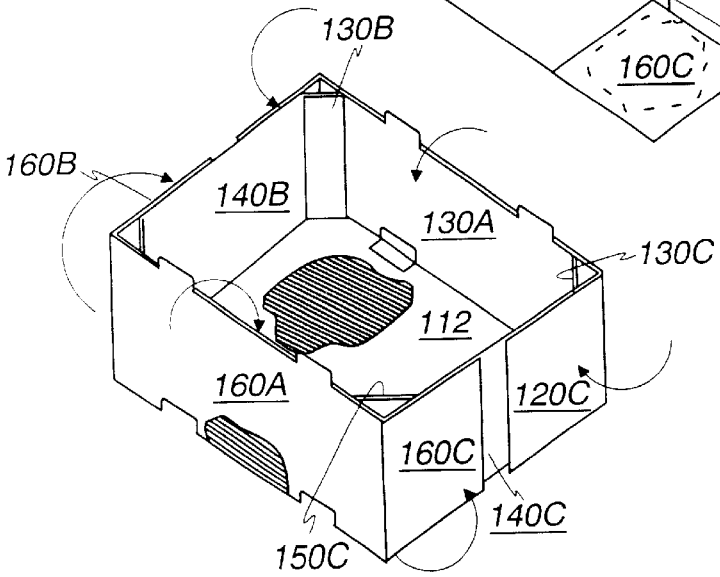

Second, as shown in FIG. 13, the end walls 140B, 140C are each rotated inward approximately 90 degrees relative to the bottom wall 112 so that the end panels 140B, 140C are generally parallel to each other. Subsequently each of the eight minor end flaps are folded in position. In particular, first minor end flaps 140D, 140I are each rotated inward approximately 45 degrees relative to the end walls 140B. First minor end flaps 140J, 140F are each rotated inward approximately 45 degrees relative to the end panel 140C. Each of the first minor end flaps 140D, 140F, 140I, 140J are adhered to the outside minor side flaps 130B, 130C, 150B, 150C respectively. Each of the second minor end flaps 140E, 140G, 140H, 140K are then folded into place adjacent a side wall panel. Specifically, second minor end flaps 140E, 140G are disposed on the outside of inner side panel 130A. Second minor end panels 140H, 140K are disposed on the outside of inner side panel 150A. As shown in FIG. 14, outer side panels 120A, 160A are each rotated outward and downward around a pair of curved score lines such that the second minor end flaps 140E, 140G, 140H, 140K are secured and captured between the outer side panels and the inner side panels. As shown in FIG. 15, the minor outer side flaps 120B, 120C, 160B, 160C are secured or adhered to opposing sides of the outer surface of the end panels 140B, 140C. It is contemplated in accordance with the present invention that the minor outer side flaps 120B, 160B may meet at the center of the outer surface of end panel 140B and minor outer side flaps 120C, 160C may meet at the center of the outer surface of end panel 140C.

While the present invention has been described with reference to the particular embodiments illustrated, those skilled in the art will recognize that many changes and variations may be made thereto without departing from the spirit and scope of the present invention. The embodiments and obvious variations thereof are contemplated as falling within the scope and spirit of the claimed invention, which is set forth in the following claims.

What is claimed is:

1. A stackable produce container, comprising:

a bottom wall;

first and second opposing side walls, each of said first and second side walls including an inner side panel and an outer side panel hingedly connected to each other and said inner side panel is hingedly connected to said bottom wall;

first and second opposing end walls;

minor side flaps extending from opposing ends of each of said inner side panels;

a first set of minor end flaps hingedly connected to opposing ends of each of said end panels; and a second set of minor end flaps hingedly connected to each of said first set of minor end flaps;

wherein said first set of minor end flaps and said minor side flaps create a diagonal corner structure.

2. The produce container of claim 1, further comprising adhesive between each of said minor side flaps and a respective minor end flap of the first set of minor end flaps.

3. The produce container of claim 1, wherein said inner side panel, said outer side panel, and said minor side flaps have vertical corrugations.

4. The produce container of claim 1, wherein said opposing end panels, said first set of minor end flaps, and said second set of minor end flaps have horizontal corrugations.

5. A stackable produce container, comprising:

a bottom wall;

first and second opposing end walls;

first and second opposing side walls, each of said first and second side walls including minor side flaps extending from opposing ends of each of said first and second side walls, said minor side flaps hingedly connected to opposing ends of each of said first and second side walls, wherein said minor side flaps reinforce corners of the container, each of said first and second side walls having an inner side panel and an outer side panel hingedly connected to each other, said inner side panel being hingedly connected to said bottom wall; and a plurality of stacking tabs located on said outer side panels.

6. The produce container of claim 5, wherein said minor side flaps are hingedly connected to each of said inner side panels.

7. The produce container of claim 5, further comprising a plurality of stacking receptacles.

8. The produce container of claim 5, further comprising a first set of minor end flaps hingedgly connected to opposing ends of each of said end panels.

9. The produce container of claim 8, further comprising a second set of minor end flaps hingedly connected to each of said first set of minor end flaps.

10. The produce container of claim 9, wherein said second set of minor end flaps are adapted to connect to said first and second side walls.

11. The produce container of claim 9, wherein said first and second end walls, said first set of minor end flaps and said second set of minor end flaps have horizontal corrugations.

12. A stackable produce container, comprising:

a bottom wall;

first and second opposing end walls;

first and second opposing side walls, each of said first and second side walls including minor side flaps extending from opposing ends of each of said first and second side walls, said minor side flaps hingedly connected to opposing ends of each of said first and second side walls, wherein said minor side flaps reinforce corners of the container; and a first set of minor end flaps hingedly connected to each of said opposing ends of each of said end panels, said first set of minor end flaps being further connected to said minor side flaps to create a diagonal corner structure.

13. The produce container of claim 12, further comprising adhesive between each of said minor side flaps and a respective minor end flap of the first set of minor end flaps.

14. The produce container of claim 12, wherein said first and second side walls and said minor side flaps have vertical corrugations.

15. The produce container of claim 12, wherein said first and second side walls and said minor side flaps have horizontal corrugations.

16. A one piece blank for forming a stackable produce container, comprising:

a central rectangular panel having a first pair of opposing edges and a second pair of opposing edges;

a first inner side panel hingedly connected to one of said first pair of opposing edges, said first inner side forming a first pair of stacking receptacles;

a second inner side panel hingedly connected to the other of said first pair of opposing edges, said second inner side panel forming a second pair of stacking receptacles;

a first outer side panel hingedly connected to said first inner side panel, said first outer side panel including a first pair of stacking tabs;

a second outer side panel hingedly connected to said second inner side panel, said second outer side panel including a second pair of stacking tabs;

a first end panel hingedly connected to one of said second pair of opposing edges;

a second end panel hingedly connected to one of said second pair of opposing edges;

minor side flaps extending from opposing ends of each of said inner side panels;

a first set of minor end flaps hingedly connected to opposing ends of each of said end panels; and a second set of minor end flaps hingedly connected to opposing ends of said first set of minor end flaps;

wherein said first minor end flaps and said minor side flaps are adapted to create a diagonal structure when said blank is formed into said container.

* * * * *

UNITED STATES PATENT AND TRADEMARK OFFICE

CERTIFICATE OF CORRECTION

PATENT NO. : 6,604,675 B2
DATED : August 12, 2003
INVENTOR(S) : James D. Southwell It is certified that error appears in the above-identified patent and that said Letters Patent is hereby corrected as shown below:

Column 6,
Line 35, delete “unpainted” and replace with -- unprinted --

Signed and Sealed this

Sixth Day of January, 2004

JAMES E. ROGAN
*Director of the United States Patent and Trademark Office*